US010113374B2

(12) United States Patent
Tengliden et al.

(10) Patent No.: US 10,113,374 B2
(45) Date of Patent: Oct. 30, 2018

(54) DEVICE AND METHOD FOR HANDLING DRILL STRING COMPONENTS IN A DRILL RIG AND DRILL RIG

(71) Applicant: ATLAS COPCO CRAELIUS AB, Märsta (SE)

(72) Inventors: Per Tengliden, Sköndal (SE); Johan Lindberg, Saltsjö-Boo (SE)

(73) Assignee: ATLAS COPCO CRAELIUS AB, Märsta (SE)

( * ) Notice: Subject to any disclaimer, the term of this patent is extended or adjusted under 35 U.S.C. 154(b) by 634 days.

(21) Appl. No.: 14/403,783

(22) PCT Filed: May 23, 2013

(86) PCT No.: PCT/SE2013/050593

§ 371 (c)(1),
(2) Date: Nov. 25, 2014

(87) PCT Pub. No.: WO2013/176618

PCT Pub. Date: Nov. 28, 2013

(65) Prior Publication Data

US 2015/0136420 A1 May 21, 2015

(30) Foreign Application Priority Data

May 25, 2012 (SE) ..... 1250531

(51) Int. Cl.
*E21B 19/16* (2006.01)
*E21B 19/20* (2006.01)
(Continued)

(52) U.S. Cl.
CPC ..... *E21B 19/16* (2013.01); *E21B 7/046* (2013.01); *E21B 15/003* (2013.01); *E21B 17/042* (2013.01); *E21B 19/20* (2013.01)

(58) Field of Classification Search
CPC ..... E21B 33/124; E21B 33/126; E21B 33/13; E21B 33/134; E21B 43/25
See application file for complete search history.

(56) References Cited

U.S. PATENT DOCUMENTS 4,319,709 A 3/1982 Jegousse et al.
6,189,620 B1 2/2001 McDowell
(Continued)

FOREIGN PATENT DOCUMENTS

WO WO-00/65193 A1 11/2000

OTHER PUBLICATIONS

Communication—European Search Report—dated Mar. 31, 2016 (Issued in Application No. 13794089.6).
(Continued)

*Primary Examiner* — Caroline N Butcher
(74) *Attorney, Agent, or Firm* — Venable LLP; Jeffri A. Kaminsi

(57) ABSTRACT

A device for handling drill string components in respect of a drill rig. A gripper is configured to grip a first drill string component to be threaded on to or off from a second drill string component being partly drilled into a rock formation. A support is configured to fasten the device onto the drill rig. A handling unit is movably connected to the support. The handling unit includes the gripper and is movable between a drill string position and a loading position. The handling unit includes an auxiliary engagement unit configured to engage the second drill string component in the drill string position and an angle variation unit configured to vary an angle of the gripper and thereby the gripped first drill string component in order to allow the alignment in the drill string position. Also a method and a drill rig.

17 Claims, 10 Drawing Sheets

(51) Int. Cl.

| | |
|---|---|
| ***E21B 15/00*** | (2006.01) |
| ***E21B 17/042*** | (2006.01) |
| ***E21B 7/04*** | (2006.01) |

(56) References Cited

U.S. PATENT DOCUMENTS

| | | | | |
|---|---|---|---|---|
| 6,550,128 | B1 | 4/2003 | Lorenz | |
| 6,634,443 | B1 | 10/2003 | Paech et al. | |
| 2003/0167623 | A1* | 9/2003 | Lorenz | E21B 19/155 29/559 |
| 2005/0161227 | A1 | 7/2005 | Hayes et al. | |
| 2009/0238663 | A1 | 9/2009 | Littlely | |
| 2010/0021271 | A1 | 1/2010 | Littlely | |
| 2013/0037324 | A1* | 2/2013 | Milivojevic | E21B 19/20 175/24 |

OTHER PUBLICATIONS

PCT/ISA/210—International Search Report—dated Oct. 8, 2013 (Issued in Application No. PCT/SE2013/050593).

PCT/ISA/237—Written Opinion of the International Searching Authority—dated Oct. 8, 2013 (Issued in Application No. PCT/SE2013/050593).

hhtp://www.youtube.com/watch?v=KLR5pp2T5ps.

* cited by examiner 48
51
52
53
54

45'
47
46
47

48
43
50
49
79
29

44
43
45
29

DEVICE AND METHOD FOR HANDLING DRILL STRING COMPONENTS IN A DRILL RIG AND DRILL RIG

CROSS-REFERENCE TO RELATED APPLICATIONS

This application claims priority to Swedish patent application 1250531-9 filed 25 May 2012 and is the national phase under 35 U.S.C. § 371 of PCT/SE2013/050593 filed 23 May 2013.

FIELD OF THE INVENTION

The invention relates to a device and a method for handling drill string components in respect of a drill rig, said device including gripping means for gripping a first drill string component to be threaded on to or off from a second drill string component being including in a drill string which is partly drilled into a rock formation. The invention also relates to a drill rig including such a device.

BACKGROUND OF THE INVENTION

Handling of drill string components in connection with joining of new components to a drill string and loosening of a drill string respectively is presently to a great extent preformed manually. Hereby a new drill string component to be joined with the drill string is placed in a drill string position, whereupon it is initially threaded manually and subsequently finally threaded by the rotator equipment of the drill rig. The reverse procedure is performed during the dismounting of the drill string into separate components during for example exchange of drill bit or completed drilling.

Core drilling for exploration drilling purposes is often preformed to great depths and with very long drill holes such as thousand meters or more. Individual drill string components, here normally drill tubes, normally have a length of for example 3 meters. Since exchange of drill bit must be preformed relatively frequently, there is required an extensive handling of the drill string components in connection with taking out the drill string from the drill hole as well as during lowering, during exchange of drill bits.

U.S. Pat. No. 6,634,443 B1 is an example of the background art. This document describes a handing device for drill string components, wherein drill string components to be joined to the drill string are transferred between a loading position and a drill string position.

THE AIM AND MOST IMPORTANT FEATURES OF THE INVENTION

The invention has as an aim to provide a device and a method according to the above which allow more secure and more efficient handling of drill string components in respect of a drill rig such that in particular the complete procedure during taking up and lowering the drill string into the drill hole can be made less subjected to upcoming problematic situations whereby totally more effective drilling can be preformed.

This aim is obtained in respect of a device according to the above in that the handling unit includes auxiliary engagement means for engagement with second drill string component being partly drilled into the drill hole in the drill string position, that the handling unit with said auxiliary engagement means is adapted for guiding and aligning said gripped first drill string component to be essentially in line with an axial direction defined by said second drill string component, and that the handling unit includes means for variation of angle of said gripping means and thereby said gripped first drill string component in respect of said support means in order to allow said alignment in the drill string position.

Hereby is achieved in an efficient way that a first drill string component being intended for joining is really aligned with the uppermost drill string component of the drill string being in the drill hole, such that in practice, aligned screw joining can be obtained which results in that threading together in fact is performed as intended and that the sensitive threaded portions of the drill string components are not unnecessarily subjected to oblique loads and thereby damages.

This is because it has been shown that in many operational cases, an angular deviation occurs between the said uppermost drill string component of the drill string being inside the drill hole and for example the feed beam of the drill rig. This inadequate alignment between the elements can be very difficult to discover for a person locking at the rig, but might still be of such importance that attempts of scream together starting out from the direction of the feed beam or any other direction of the rig will be unsuccessful, which can result in that an attempted thread joining fails and/or that the threads of the drill strings components are damaged. In the best case the damage is such that joining together can still be obtained, but also minor damages result in reduced working life of the drill sting components and thereby unnecessary costs.

By the invention thus providing auxiliary engagement means in combination with the means for variation of angle, the possibility of aligning the gripped first drill string component in line word or at least essentially in line with an outermost region of the second drill string component being the uppermost drill string component of the drill string in the drill hole.

By this alignment being ensured through the invention threading together is facilitated and, further, above mentioned problems with damages to the drill string components are avoided as well as failing joining attempts.

In order to achieve good effect, said auxiliary engagement means are advantageously arranged to engage portions of the second drill string component being located at an axial distance from each other or with at least a certain axial extension, for an alignment to be practically achieved when engagement with a second drill string component is initiated. A variant of said auxiliary engagement means is suitably one single clamping means having clamping surfaces from the group: engagement elements such as clamping ridges positioned at a distance from each other as seen in an axial direction of a gripped drill string component, engagement elements that extend over a portion of a gripped drill string component seen in the axial direction, such as jaws having a width, seen in said axial direction, which in general at least corresponds to the diameter of a drill string component. In particular it is preferred that said auxiliary engagement means is comprised of two or more manoeuvrable clamping means positioned at a distance from each other. Hereby is achieved that the alignment can be obtained with a high degree of security without having to use great application forces or clamping forces.

It is preferred that said means for variation of angle include joint means with play or flex between parts involved and particularly that said joint means are constructed with play or flex in radial direction such that distances between two elements are variable, and/or with resilience in rotational direction between the parts involved, which gives the possibility of a simple construction wherein said distances can be increased with simple means if necessary.

Hereby, preferably said play or flex and resilience between parts involved is against action of elastic elements.

As a variant, said means for variation of angle includes a divided support arm which is positioned between said support means and gripping means, and which includes at least one elastic element between parts of the support arm. This solution allows a simpler construction and as an example can be taken elastic elements between the parts of the support arm being comprised of at least one ring-shaped elastic bushing of a rubber or plastic material. Each bushing can then be inserted into a recess in the one support arm portion such that its outer envelopes surface lies against an inner surface in the recess. Against an inner surface of the bushing lies a pin which is rigidly joined to the second support arm portion.

Said support means preferably includes a rigid frame body which carries a rotation actuator in the form of a swing motor for pivoting the handling unit between the drill string position and the loading position.

It is preferred that said auxiliary engagement means and said gripping means are attached on a common carrier, which to a high degree facilitates alignment. This carrier contributes together with said auxiliary engagement means and said gripping means in the angling variation in respect of said frame body.

Said gripping means suitably includes rotation wheels for rotation threading, wherein the rotation can be controlled for threading together or threading apart of the respective components.

Said gripping means are arranged to provide a gripped first drill string component with an axial movement in connection with it being treaded together with or be threaded apart from a second drill string component such that the rotation is related to the axial movement in order to be adapted to the pitch of the thread in question.

According to one aspect of the invention, a support means includes a slide beam being arranged essentially in parallel with a feed beam of the drill rig, and whereon a slide is drivable to and fro, wherein the handling unit is connected to this slide. This gives the possibility of setting the loading position to prevailing situation and requirement. Preferably the handling unit is movably connected to said slide over an angling arrangement including a rotation motor with a rotational axis being positioned in a plane perpendicular to a longitudinal axis of the slide beam, for swinging the handling unit with a gripped drill string component between a position in parallel with the drill string position and a horizontal loading position. Hereby loading is facilitated and in particular automatic loading is simplified, whereby a magazine having horizontally positioned drill string components is connected to a drill rig according to the invention.

A method according to the invention for handling drill string component in a drill rig is distinguished in that auxiliary engagement means, being included in the handling unit, in the drill string position are brought to engage said second drill string component, that said gripped first drill string component of said auxiliary engagement means is controlled and aligned to essentially in line with an axial direction defined of said second drill string component, and that said gripping means and thereby said gripped first drill string component is imparted said alignment by allowing angling variation in respect of said rigid frame body.

Method features corresponding to the above mentioned subordinate device features are appropriate in and are preferred in respect of subordinate method claims.

A drill rig according to the invention includes an inventive handling device.

BRIEF DESCRIPTION OF DRAWINGS

The invention will now be described in greater detail at the background of embodiments and with reference to the annexed drawings, wherein.

DESCRIPTION OF EMBODIMENTS

Figure 1:
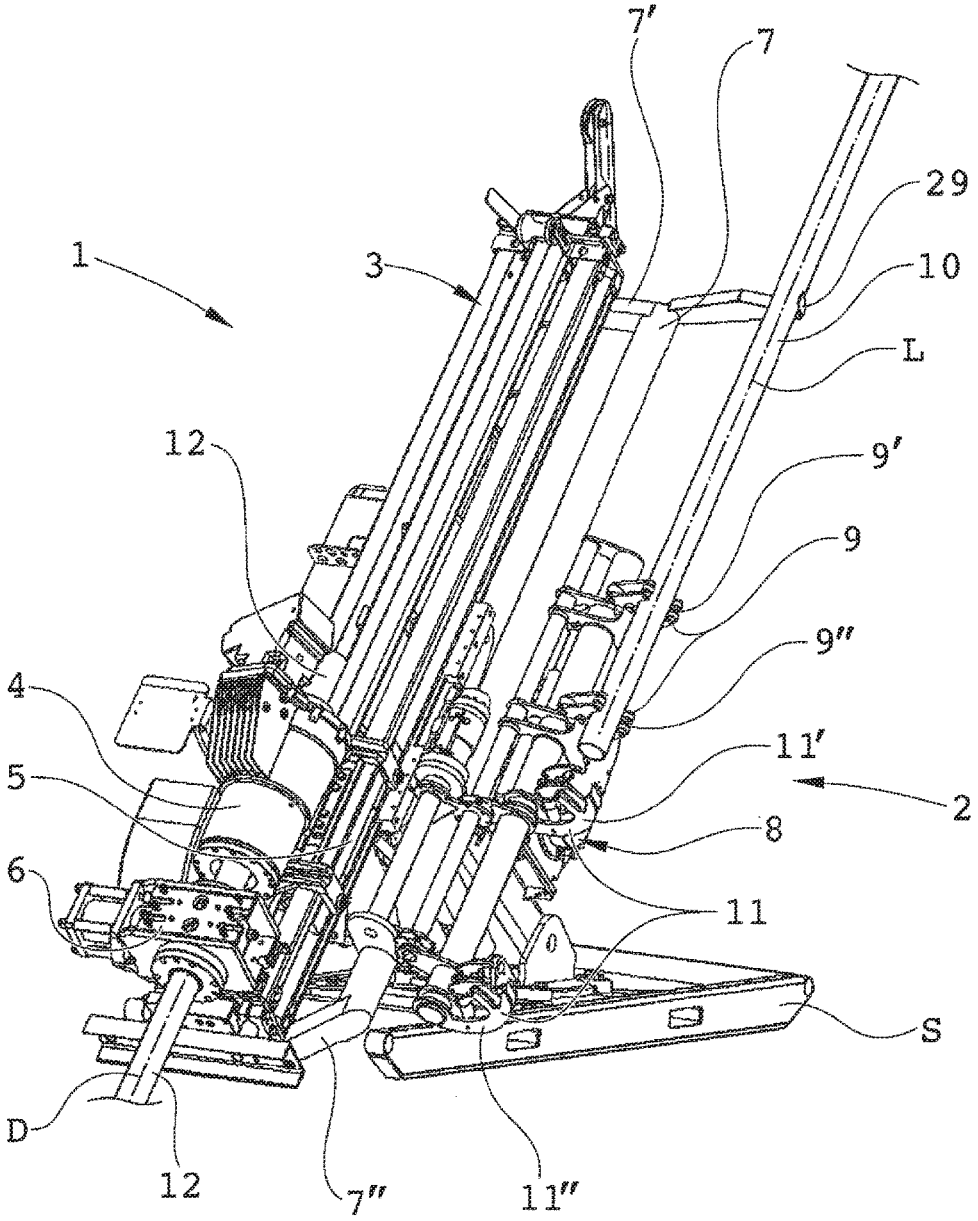
FIGS. 1 and 2 show a drill rig equipped with a device according to the invention in two different handling positions.

FIG. 1 shows a drill rig 1 for core drilling being supported by a support structure S, said drill rig as usual being equipped with a feed beam 3, a carriage 5 being drivable back and forth and having a rotator for driving and rotating a drill string with an upper second drill string component 12 and a lower drill string holder 6.

7 indicate a support means comprising a frame body for fastening a device 2 for handling drill string components (named handling device) on the rig. Connecting beams 7' and 7" are arranged for fastening a support means 7 in the regions of the upper and lower ends of the feed beam 3.

The support means 7 in the shown example includes a tubular body, wherein a swing device is arranged, which in turn includes a swing motor 13 and a swing shaft 14. The swing shaft is connected to the support means 7 with the aid of fastening ears with swing bearings for said swing shaft 14. The tube-formed body being a support means is arranged sideways of and (with a central axis) in parallel to the feed beam.

The handling device 2 includes gripping means (globally indicated with 9) for gripping a first drill string component 10 to be put into a drill string position D in the rig or to be taken out from the rig for subsequent positioning in a magazine.

Reference numeral 29 relates to a support which is rigidly applied at an upper region of the support means 7 for support and for assistance during positioning of the first drill string component 10 in the position shown in FIG. 1, which is named loading position L.

The handling device 2 also includes auxiliary engagement means (globally indicated with 11) being intended to engage with a second drill string component 12, in an outermost part thereof, being uppermost in the drill string being drilled into the rock in the drill string position D and somewhat protruding from the rotator 4 in a manner which will be explained below.

Figure 2:
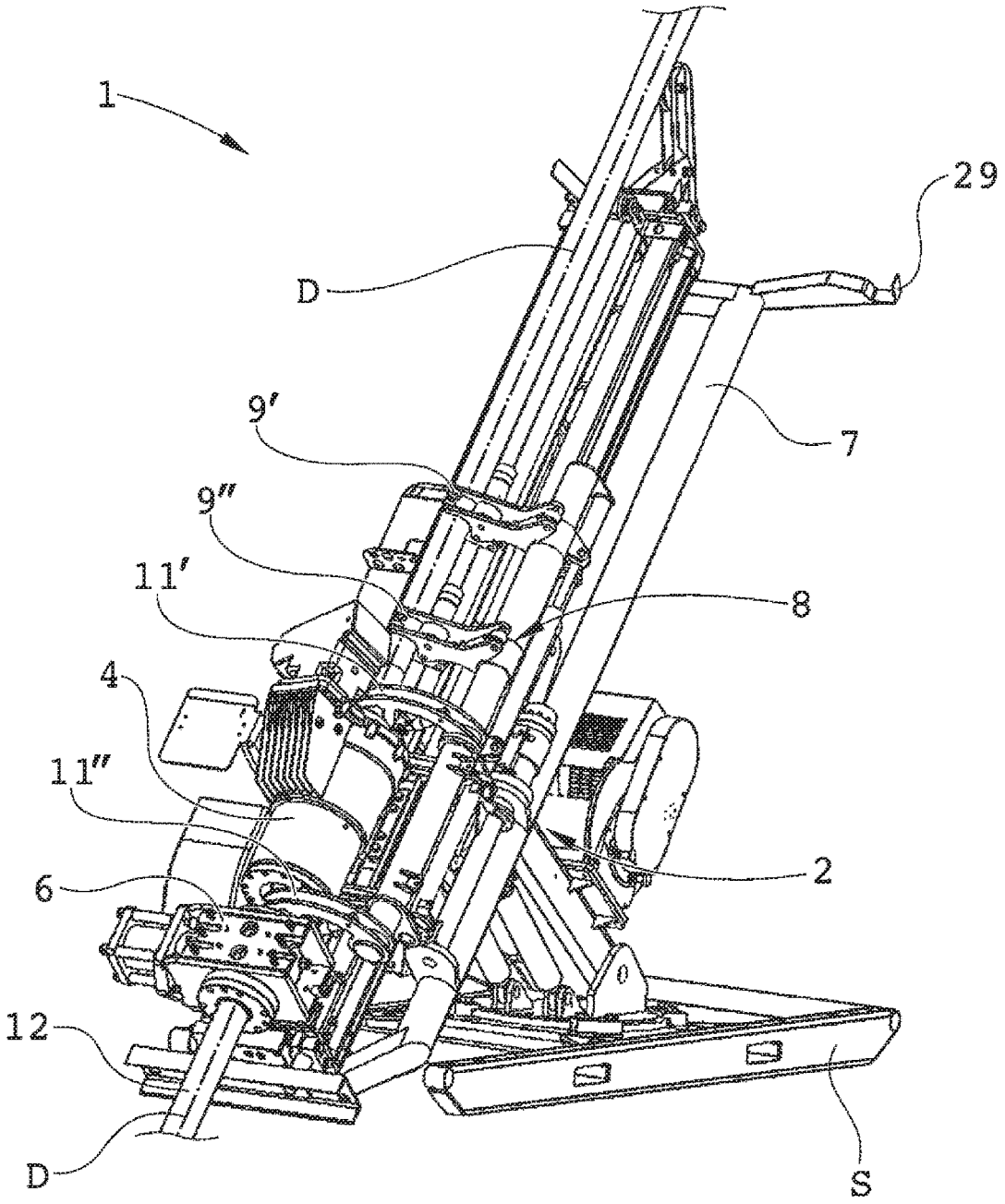

In FIG. 2 the rig 1 is shown with a handling device 2 in a second position, wherein the first drill string component 10 is in the drill string position D, that is in a position when the first drill string component 10 as well as the second drill string component 12 being uppermost in the drill string is in the drill string position D. In this position, the auxiliary engagement means (globally indicated with 11) now have come into engagement with a second drill string component 12.

The uppermost, as seen in the Figure, first auxiliary engagement means named 11' being outermost on the existing drill string, is shown in engagement with the portion of the drill string component 12 protruding from the rotator 4. 11" indicates a second auxiliary engagement means, which is positioned for engagement with the second drill string component 12 in a space between the rotator 4 and the lower holder 6. During activation of the auxiliary engagement means 11' and 11" there is actively obtained an alignment of a longitudinal, here shown tubular, holder for a handling unit 8, which includes said holder and said auxiliary engagement means 11' and 11" as well as also the gripping means 9, which in this embodiment includes two gripping means 9' and 9" being positioned at a distance from each other as seen in an axial direction of a gripped drill string component. Since the gripping means 9' and 9" are still in engagement with the first drill string component 10 said mutual alignment of the drill string components 10 and 12 is hereby initiated.

In order for this to be possible, there exists in the handling device 2 a resilience of a portion which is between the holder of the handling unit 8 which carries and directly co-operates with the gripping means and the auxiliary engagement means, and said support means 7 in a manner which is clarified below.

Activating the auxiliary engagement means 11' and 11" will thereby provide an appropriate alignment of the first drill string component 10 with a second drill string component 12 for a subsequent threading operation.

Figure 3:
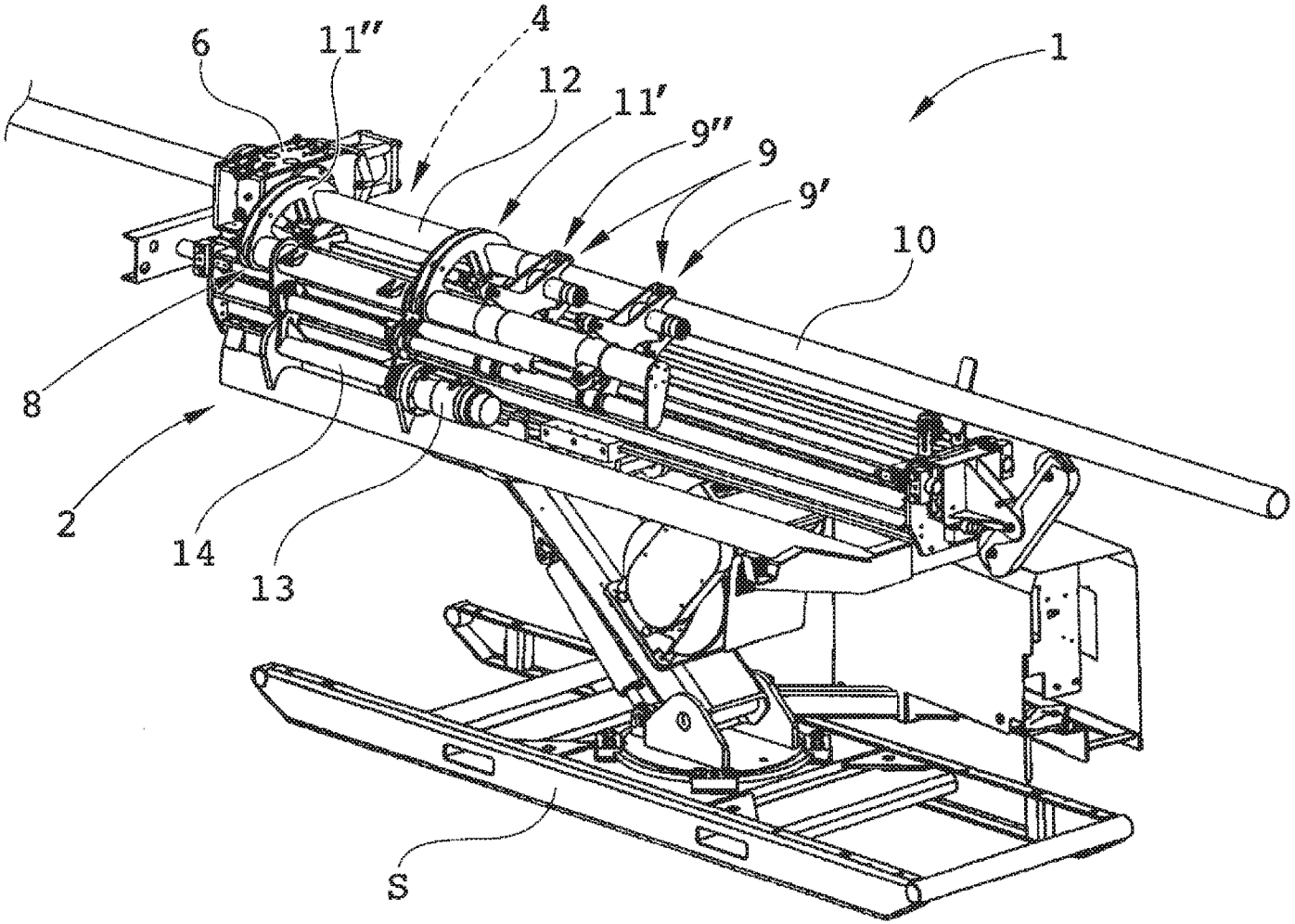
FIG. 3 shows the drill rig in FIGS. 1 and 2 with some components removed for clarity and with the rig with a new drill string component brought into a drill string position.

FIG. 3 shows the rig with the feed beam in a position where it is essentially parallel to the support structure S of the rig 1 and wherein the rotator and other elements for clarity are removed from the position between the auxiliary engagement means 11' and 11" from the position being indicated with an interrupted arrow at reference number 4.

Said gripping means 9 can as alternative to include two separated gripping means 9' and 9" be in the form of one single clamping and holder device (not shown) which has a sufficient extension seen in an axial direction of a gripped drill string component for the stability to be maintained. Suitably such a clamping and holder device is combined with at least one support for a gripped drill string component arranged at a distance from the very gripping means.

Figure 4:
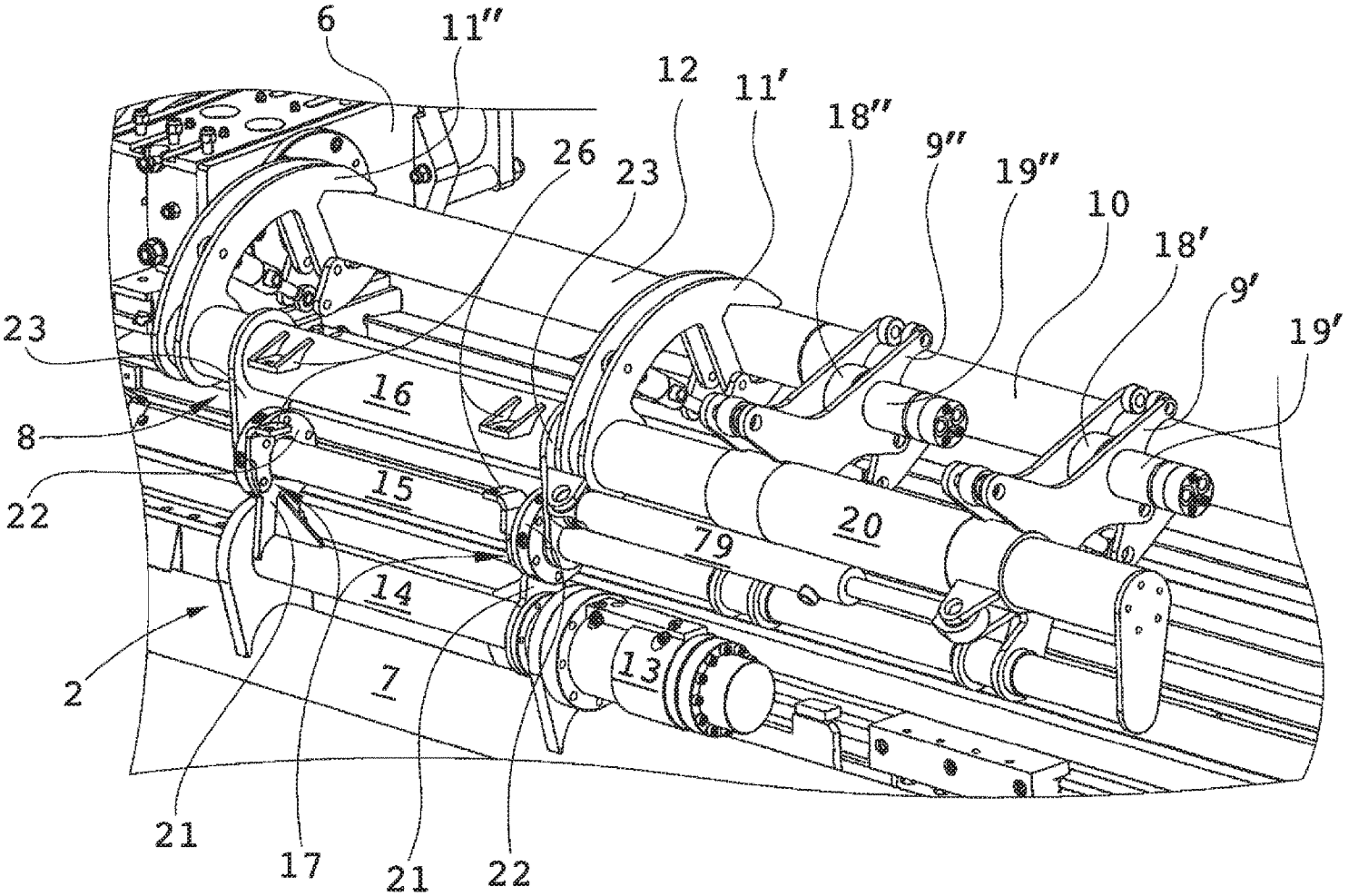
FIG. 4 shows a detail of the rig in FIG. 3 in enlarged scale.

FIG. 4 shows the area of the gripping means 9' and 9" and the auxiliary engagement means 11' and 11" in greater detail. It is apparent that each gripping means 9' and 9" includes a rigid jaw and a movable jaw which is manoeuvrable for opening and closing with the aid of a respective hydraulic cylinder. Outermost on each jaw there are rotation rollers (not shown on the movable jaws) and inside each gripping means there is also a rotation wheel 18' and 18" respectively, which are rotationally driven by way of a respective rotation motor 19' and 19".

In closed position of the first jaw of each gripping means 9' and 9", the first drill string component 10 lies in three points against respective gripping means, viz. against the rotation wheels outermost on the jaws and against the rotation wheel. This results in that the drill string component 10 can be rotation during initiation of the rotation motors 19' and 19" for the purpose of thread joining and separating of the first drill string component 10 in respect of the second drill string component 12.

Further, the gripping means 9' and 9" are carried axially movable in respect of the auxiliary engagements 11' and 11". The gripping means 9' and 9" are attached axially movable in respect of a holder shaft 16 over a sleeve 20. This holder shaft 16 comprises the above mentioned tubular holder for the handling unit 8.

17 indicates globally means for variation of angle, which are arranged between the holder shaft 16 and the rotational axis 14.

The gripping means 9' and 9" are further supported over respective axially movable auxiliary sleeves on an additional strut extending in parallel to the holding shaft, comprising an intermediate axis 15 of the handling device 2. Altogether, the gripping means 9' and 9" can be parallel-displaced in respect of the auxiliary engagement means and the displacement be driven by a hydraulic cylinder 79.

Also each one of the auxiliary engagement means 11' and 11" includes a rigid and a movable jaw, wherein the movable jaws are manoeuvrable by way of hydraulic cylinders. The auxiliary engagement means do not include any rotation rollers as a contrast to the gripping means.

Between the swing shaft 14 and the holder shaft 16 of the auxiliary engagement means 11' and 11" and the gripping means 9' and 9" is thus positioned the intermediate shaft 15, which in the shown embodiment is firmly connected to the holder shaft 16 over swing arms 23 being positioned at an axial distance from each other. The intermediate shaft 15 extents through two axially separated resilient yielding hubs, here named flex hubs 22, being supported by a respective swing ear 21 being rigidly connected to the swing arm 14.

The flex hubs 22 allow radial flex of the intermediate shaft 15 in respect of a body of the hub, allowing angular deviation between the intermediate shaft 15 and the swing shaft 14 and thereby between the holder shaft 16 for the gripping means respectively the auxiliary engagement means and the support means 7 and thereby the feed beam 3 of the rig.

Besides a radial yieldingness, the flex hubs 22 also allows a rotational yield, which is against action of a spring means (one shown and indicated with 25 in FIG. 5) adapted to be fastened to holders 26 between the holder shaft 16 and the intermediate shaft 15, said spring means being removed on FIG. 4 for increased clarity.

Figure 5:
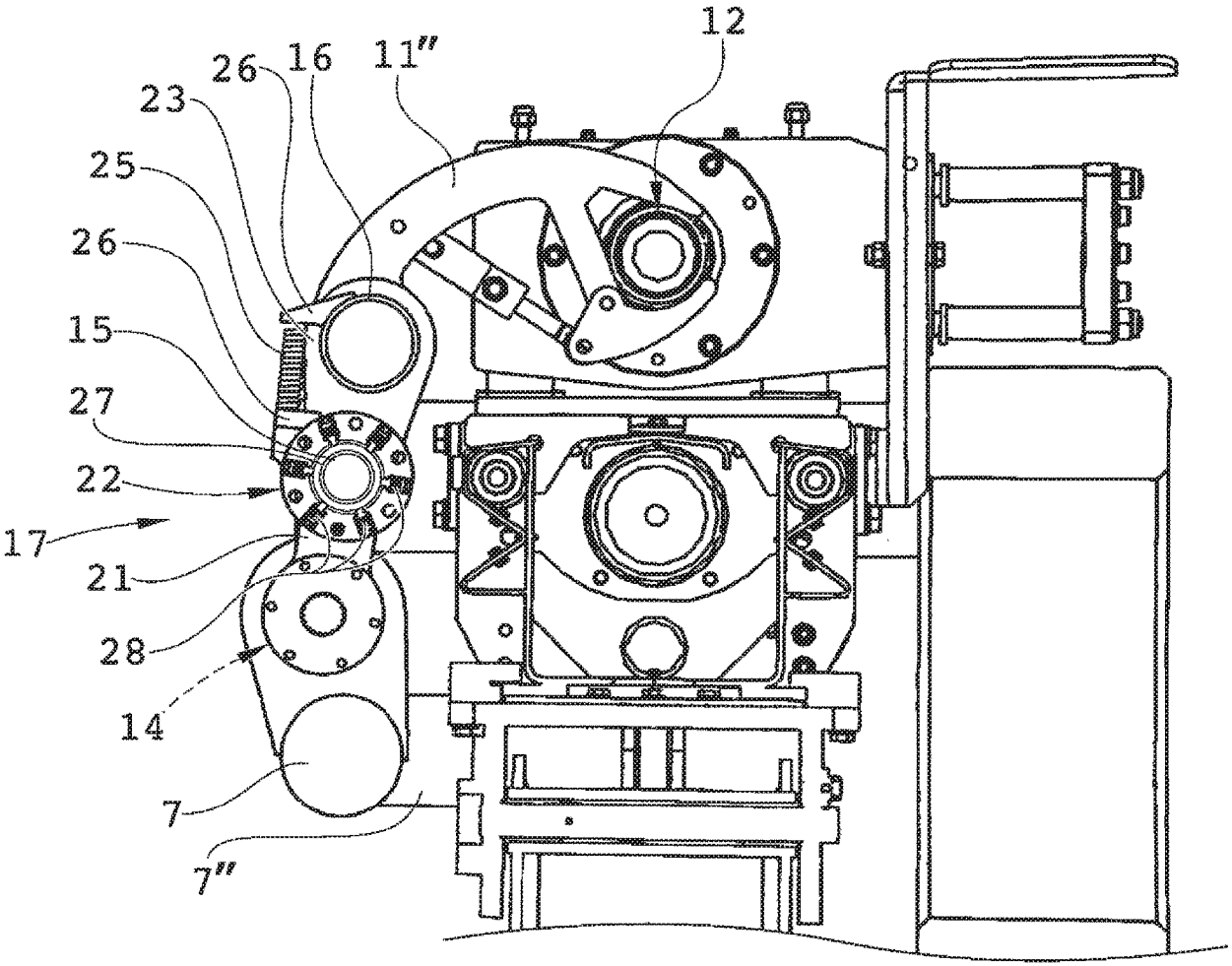
FIG. 5 shows the means for variation of angle in enlarged scale and with certain details removed.

FIG. 5 shows in greater detail the construction of the means 17 for variation of angle, wherein it is understood that a flex hub 22 is supported with an inner bearing sleeve 27 carried over radial spring means 28 distributed peripherally within an outer bearing sleeve for allowing the radial flex for obtaining that the holder shaft 16 in this section can be displaced a certain distance in respect of the swing shaft 14. The rotation of the intermediate shaft 15 in respect of the flex hubs 22 is against action of the spring means 25, wherein the centre distance between the holder shaft 16 and the swing shaft 14 can be altered further.

The invention can be modified within the scope of the following claims. Thus, the gripping means as well as the auxiliary engagement means can be constructed otherwise and also be arranged to engage the respective drill string component in another way. As is indicated above, it is preferred that said auxiliary engagement means are two or more activatable clamping means at a distance from each other. It is, however, not excluded that any or all of the auxiliary engagement means are guiding means without clamping functions in the form of elements with guiding recesses for guiding engagement with and alignment with the drill string components in question, for example when pressing the handling unit in the direction of the drill string component such that the gripped first drill string component will become properly aligned and secure threading together can be achieved. Such guiding recesses can have U-shaped, V-shaped, L-shaped etc.

The invention has been described at the background of core drilling with drill string components being drill tubes, but it should be noted that the invention is applicable also in other types of drilling where the drill string is comprised of threaded drill string components. Also other types of drill string components being part of a drill string, such as lifting plugs and various other elements can, of course, be handled by the inventive device.

Figure 6:
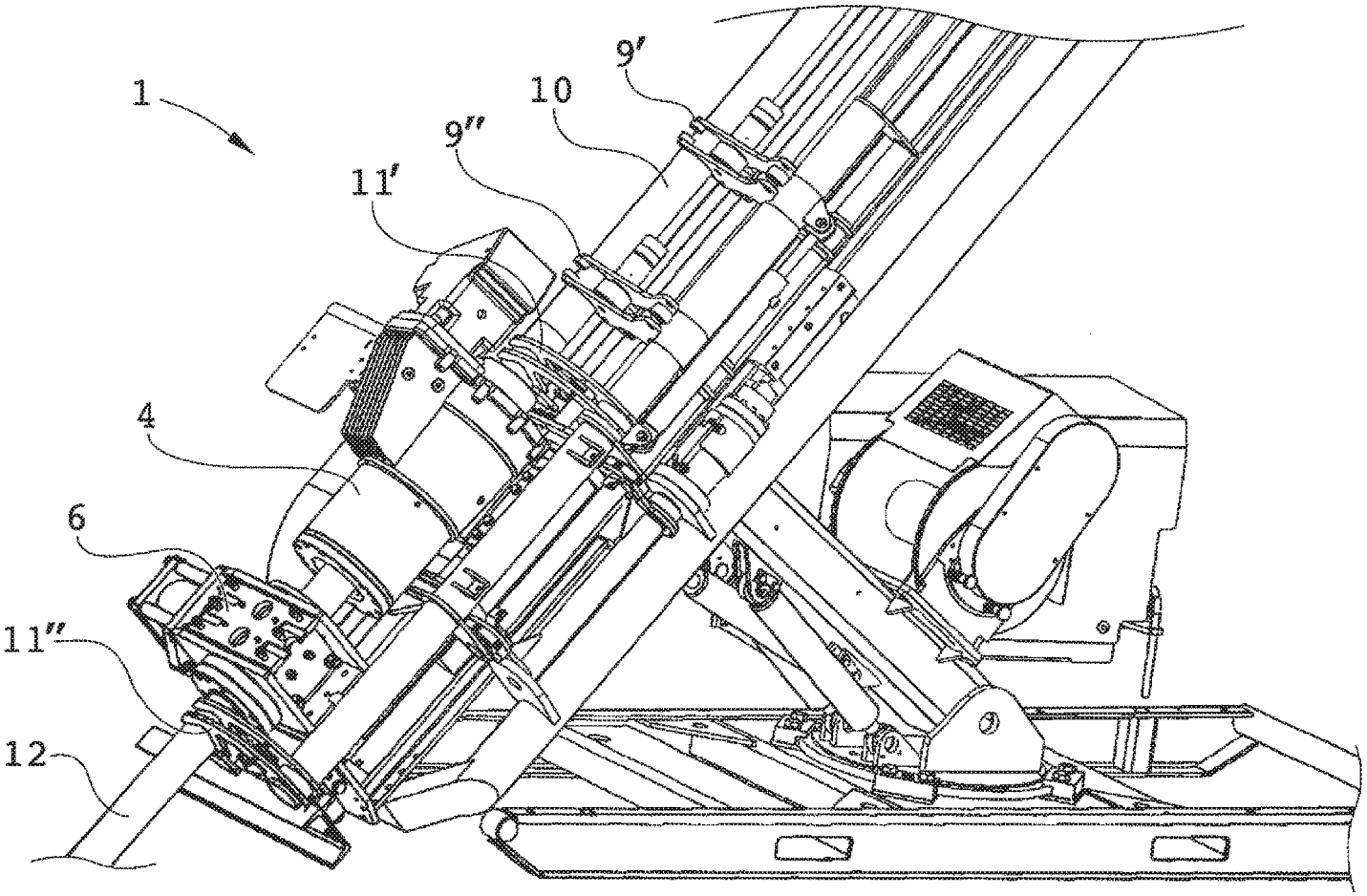
FIGS. 6 and 7 show rigs with alternatively positioned auxiliary engagement means.
Figure 7:
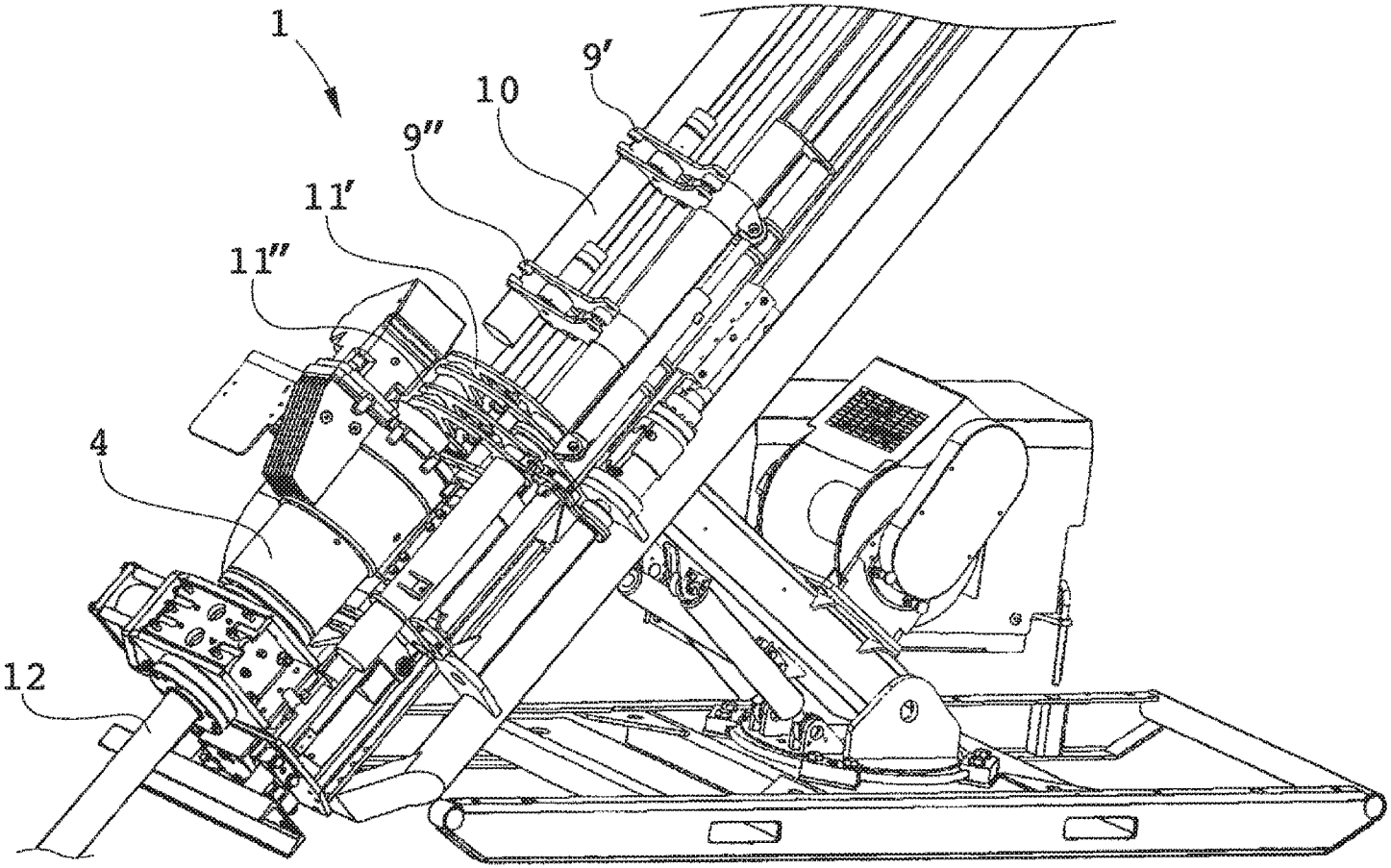

An example of different positioning of auxiliary engagement means is given in FIG. 6, wherein in the Figure a lower or forward auxiliary engagement means is positioned for engagement with a second drill string component in front of the lower holder 6, whereas in FIG. 7 it is shown that the positioning of the forward or in the Figure lower auxiliary engagement means 11" at a smaller distance from, but adjacent to the upper auxiliary engagement means 11' on the second drill string component 12 protruding from the rotator 4. An advantage with the arrangement according to FIGS. 6 and 7, in respect of the one in FIGS. 1, 2 etc. is that deeper drilling is allowed in these cases since the rotator can be driven all the way to the holder 6.

Also other variants can come into question, essential is that the auxiliary engagement means 11' and 11" are arranged for engagement at such a great distance from each other with the second drill string component 12, that adequate alignment can be had. Further, it is of course essential that there is a flexibility in the connection of the part of the handling device 2 which carries the gripping means respectively the auxiliary engagement means in respect of the rig such that a redirection according to the above to align with a real direction of the second drill string component is obtained.

Figure 8:
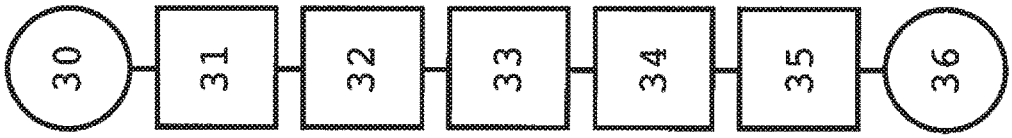
FIG. 8 illustrates an inventive method sequence.

FIG. 8 diagrammatically illustrates a method sequence, wherein:

Position 30 indicates the start of the sequence.

Position 31 indicates gripping by way of gripping means of a first drill string component to be threaded together with a second drill string component being part of a drill string and being partly drilled into a rock formation.

Position 32 indicates manoeuvring of a handling unit being movably connected to a support means and including said gripping means to a drill string position (D) wherein a gripped first drill string component is positioned for threading together with said second drill string component from a loading position (L), in which a drill string component can be brought into said gripping means. It is preferred that the handling unit is movably connected to the support means over a swinging device. This one is preferably constructed with a swing motor being supported by the support means and being arranged to swing drive arms for providing a swing movement to the handling unit. Another relative movement between these elements is, however, not excluded.

Position 33 indicates that auxiliary engagement means being part of the handling unit in the drill string position is brought to come into engagement with said second drill string component.

Position 34 indicates that said first drill string component being gripped by said auxiliary engagement means is guided and aligned to be essentially in line with an axial direction defined by said second drill string component.

Position 35 indicates that said gripping means and thereby said gripped first drill string component is allowed said alignment by allowing angle variation in respect of said support means.

Position 36 indicates the end of the sequence.

The steps in the positions 33-35 are overlapping. Further steps such as thread driving, tightening etc will be performed in the actual use of a handling device according to the invention. The corresponding sequence is applicable for removing drill string components from the rig.

Figure 9:
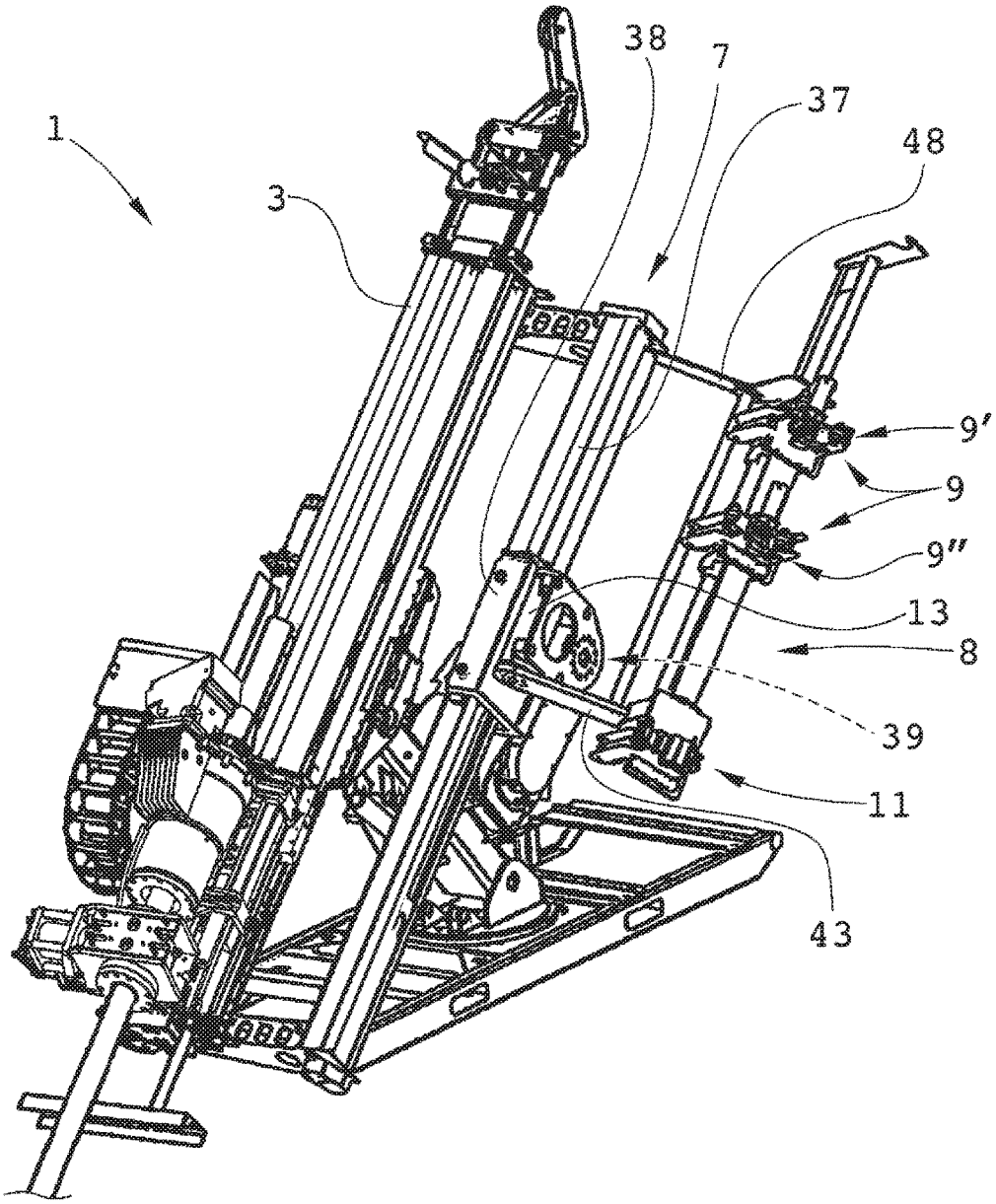
FIG. 9 shows in a perspective view a drill rig equipped with an alternative device according to the invention.

FIG. 9 shows in a perspective view a drill rig 1 equipped with an alternative device according to the invention. According to this aspect of the invention, which is clearer in FIG. 10, the support means 7 includes a slide beam 37 being essentially parallel with the feed beam 3 of the drill rig and having a slide 38 being drivable to and fro, wherein the handling unit is connected to said slide. This gives the possibility of adjusting the loading position to prevailing situation and requirement. The handling unit 8 is movably connected to said slide 38 over an angling arrangement which includes a rotational motor 39 (shown in this embodiment according to FIG. 10) with a rotational axis 40 (FIG. 10) being extending in a plane at a right angle to a longitudinal axis of the slide beam 37, for rotating the handling unit 8 with gripped drill string component between a position in parallel with the drill string position and a horizontal loading position (not shown). Hereby loading is facilitated and in particular automatic loading is simplified, wherein one (not shown) magazine having horizontally positioned drill string components is connected to a drill rig according to the invention. The rotational motor 39 can be oriented otherwise in respect of the slide than what is shown on FIGS. 9 and 10 with maintaining the rotational axis 40 in a plane at a right angle to a longitudinal axis of the slide beam 37.

Figure 10:
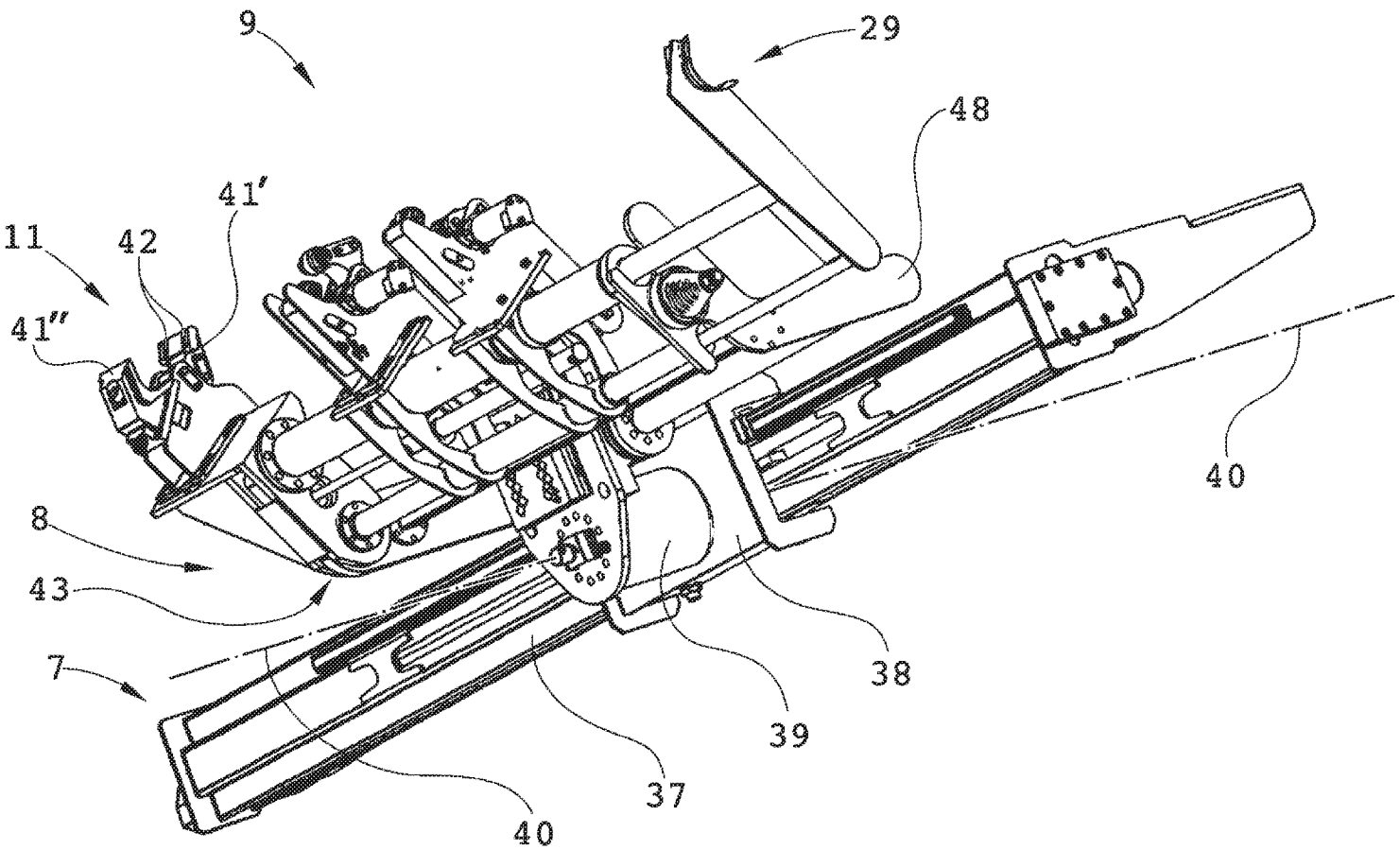
FIG. 10 shows the device according to FIG. 9 in an enlarged scale in another perspective view, and FIGS. 11*a* and *b* show a detail of the device in FIG. 10 in a side view and in section A-A respectively.

FIG. 10 shows a variant of said auxiliary engagement means 11 in the form of one single clamping means with a movable jaw 41' and rigid jaw 41". On the jaws there are arranged clamping surfaces which are constructed as clamping ridges 42 (shown on the movable jaw 41') positioned at a distance from each other as seen in an axial direction of a gripped drill string component.

A plurality of components in FIGS. 9 and 10 essentially correspond to the above described corresponding components in FIGS. 1-7, which can be consulted for understanding. A rotational actuator for swinging the handling unit 8 between the drill string position and the loading position is indicated with 13 (FIG. 9).

Figures 11A, 11B, 11C, 11D:
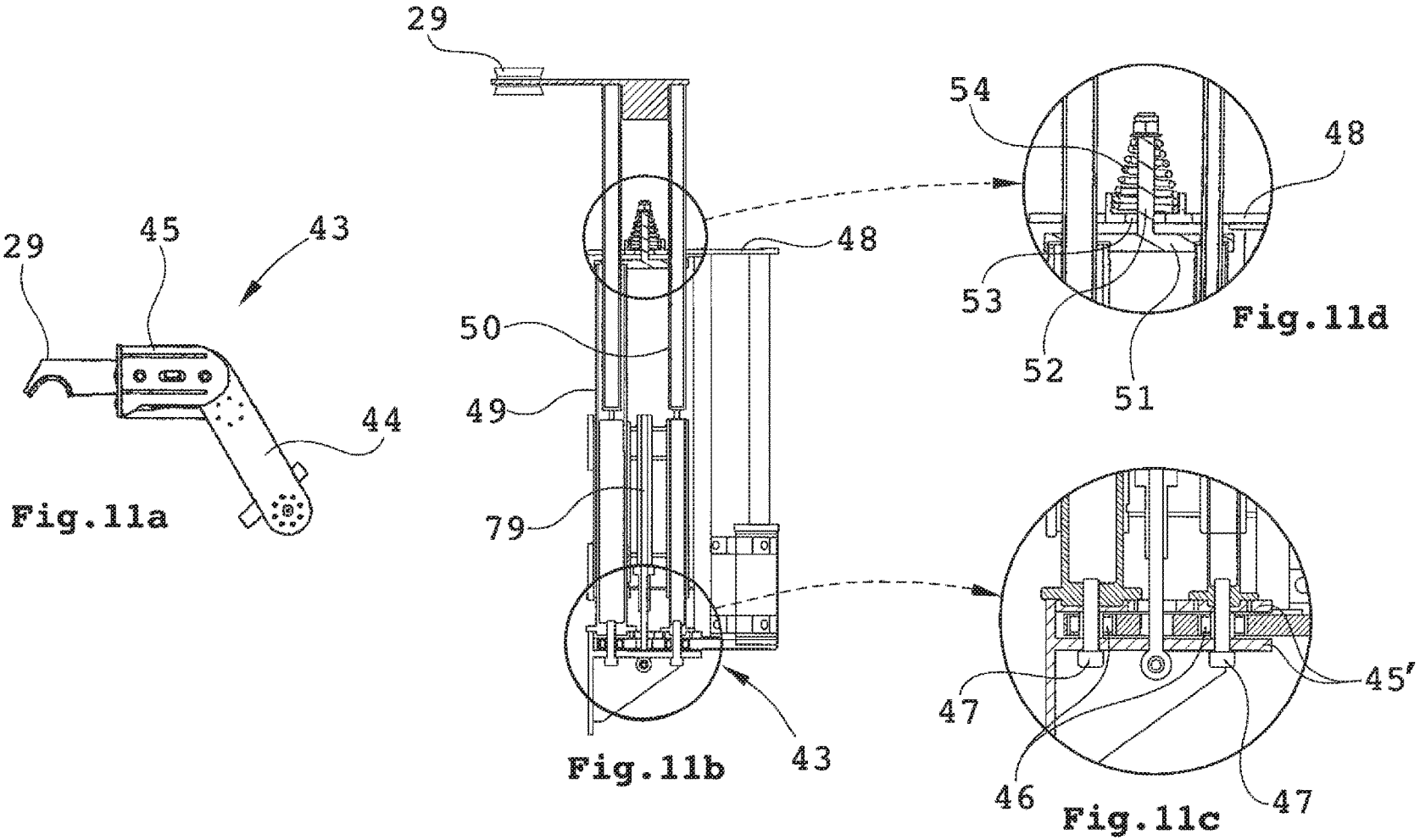
FIGS. 11*a* and *b* show elements appearing on FIG. 11*b* in greater detail.

FIGS. 11 *a, b, c* and *d* show in greater detail said means for variation of angle, which includes a divided support arm 43 positioned between said support means 7 and said gripping means as well as an auxiliary support arm 48 (see also FIG. 9). The support arm 43 includes in this embodiment two elastic elements positioned between the parts 44 and 45 of the support arm 43. Said elastic element between the parts of the support arm here includes two ring-shaped elastic bushings 46 of a rubber or plastic material between an outer and an inner metal ring. Each bushing 46 is inserted into a recess in the one support arm part 44 such that its outer envelope surface lies against an inner surface in the recess.

Against an inner surface of the bushing lies a pin 47 in the form of a screw, which is rigidly joined to the second support arm part 45, which in this case is comprised of two fastening ears 45', which enclose a first support arm part.

The second support arm part 45 is rigidly joined with first ends of suitably tubular parallel struts 49 and 50 corresponding to the holder shaft 16 and the intermediate shaft 15 in the embodiment according to FIG. 4. Rigidly joined to second ends of the parallel struts 49 and 50 is a cross strut 51. The cross strut forms a rigid, essentially rectangular frame together with the parallel struts 49 and 50 and with a second support arm part 45. A guiding pin 52 is arranged on the cross strut 51 for together with a guiding recess 3, here in the form of a circular hole in the auxiliary support arm 48, forming an arrangement for play and flex limitation for said means for variation of angle. 54 indicates an elastic means for controlling said play and flex limitation. In the shown example, the elastic means 54 acts between the guiding pin and the auxiliary support arm and is here comprised of a conical spring. Alternative elastic means for controlling said play and flex limitation can be envisaged and be inserted between the cross strut 51 and the auxiliary support arm 48.

79 indicates a cylinder, which acts in a manner corresponding to what is described with reference to FIG. 4 for displacement of the gripping means 9, 9' and 9" respectively, in order to obtain axial movement of these elements corresponding to what is explained in connection with said FIG. 4.

The invention claimed is:

1. A device for handling drill string components in respect of a drill rig, said device comprising:

a gripper configured to grip a first drill string component to be threaded on to or off from a second drill string component being part of a drill string which is partly drilled into a rock formation, a support configured to fasten the device for handling drill string components onto the drill rig, a handling unit which is movably connected to said support, which includes said gripper, and which is movable between a drill string position, in which the gripped first drill string component is positioned for threading on to and off from said second drill string component and a loading position wherein the first drill string component can be brought into or taken out from said gripper, wherein the handling unit includes an auxiliary engagement unit configured to engage said second drill string component in the drill string position, wherein the handling unit with said auxiliary engagement unit is adapted to guide and align said gripped first drill string component to be essentially in line with a longitudinal axis direction defined by said second drill string component, wherein the handling unit includes an angle variation unit configured to vary an angle of said gripper and thereby said gripped first drill string component with respect to the support in order to allow said alignment in the drill string position, wherein said auxiliary engagement unit is adapted to engage portions of the second drill string component, said portions being positioned at a longitudinal axial distance from each other, wherein the angle variation unit comprises a joint with play or flex between parts comprising the joint, and wherein the joint is formed with play or flex in radial direction with respect to a body of the parts of the joint and/or with yieldingness in rotational direction between its parts.

2. The device according to claim 1, wherein said auxiliary engagement unit comprises a clamp comprising clamping surfaces selected from the group consisting of: engagement elements being positioned at a distance from each other in a longitudinal axis direction of a gripped second drill string component or engagement elements that extend over a portion, in the longitudinal axis direction, of the gripped second drill string component.

3. The device according to claim 1, wherein said auxiliary engagement unit comprises at least two activatable clamps being positioned at a distance from each other.

4. The device according to claim 1, wherein said play or flex and yieldingness between parts of the joint is adapted to be against the action of elastic element or elements.

5. The device according to claim 1, wherein said angle variation unit includes a divided support arm being positioned between said support and said gripper and at least one elastic element is arranged between parts of the divided support arm.

6. The device according to claim 1, wherein said support includes a rigid body which carries a rotational actuator for swinging the handling unit between the drill string position and the loading position.

7. The device according to claim 1, further comprising:

a common carrier to which said auxiliary engagement unit and said gripper are fastened.

8. The device according to claim 1, wherein said gripper includes rotation rollers for threading rotation.

9. The device according to claim 1, wherein said gripper is arranged to provide the gripped first drill string component, when gripped, a longitudinal axial movement in connection with the first drill string component being threaded on to or off from a second drill string component.

10. The device according to claim 1, wherein the handling unit is connected to a slide drivable to and fro on a slide beam being included in the support, said slide beam being essentially in parallel with a feed beam of the drill rig.

11. The device according to claim 10, wherein the handling unit is movably connected to said slide over an angling arrangement, which includes a swing motor having a swing axis being disposed in a plane perpendicular to a longitudinal axis of the slide beam for swinging the handling unit with a gripped first drill string component between a position in parallel with the first drill string component and a horizontal loading positions.

12. A method for handling drill string components in respect of a drill rig, the method comprising:

gripping with a gripper, a first drill string component, to be threaded on to or off from a second drill string component being part of a drill string which is partly drilled into a rock formation, maneuvering a handling unit which is movably connected to a support, and which includes said gripper, between a drill string position, in which a gripped first drill string component is positioned for threading on to and off from said second drill string component and a loading position, wherein the first drill string component can be brought into or taken out from said gripper, bringing an auxiliary engagement unit included in the handling unit to engage said second drill string component in the drill string position, guiding said gripped first drill string component through said auxiliary engagement unit and aligning the gripped first drill string component to be essentially in line with a longitudinal axis direction defined by said second drill string component, and allowing said gripper and thereby said gripped first drill string component said alignment through allowing variation of angle of said gripped first drill string component in respect of said support in order to allow alignment of the first drill string component in the drill string position, wherein said auxiliary engagement unit engages portions of the second drill string component, said portions being positioned at a longitudinal axial distance from each other, and wherein play or flex or yieldingness between parts of a divided support arm being positioned between said support and said gripper.

13. The method according to claim 12, wherein said play or flex or yieldingness is against the action of elastic element or elements.

14. The method according to claim 12, further comprising:

making the handling unit swing between the drill string position and the loading position utilizing a rotational actuator.

15. The method according to 12, further comprising:

threadingly rotating and providing a longitudinal axial movement to a gripped first drill string component in connection with threading the first drill string component on to or off from a second drill string component.

16. A drill rig comprising:

a carrier unit, a feed beam and a drill string drive device being movable to and fro on the feed beam, a device for handling drill string components comprising:

a gripper configured to grip a first drill string component to be threaded on to or off from a second drill string component being part of a drill string which is partly drilled into a rock formation, a support configured to fasten the device for handling drill string components onto the drill rig, a handling unit which is movably connected to said support, which includes said gripper, and which is movable between a drill string position, in which a gripped first drill string component is positioned for threading on to and off from said second drill string component and a loading position wherein a first drill string component can be brought into or taken out from said gripper, wherein the handling unit includes an auxiliary engagement unit configured to engage said second drill string component in the drill string position, wherein the handling unit with said auxiliary engagement unit is adapted to guide and align said gripped first drill string component to be essentially in line with a longitudinal axial direction defined by said second drill string component, wherein the handling unit includes an angle variation unit configured to vary an angle of said gripper and thereby said gripped first drill string component with respect to the support in order to allow said alignment in the drill string position, and wherein said auxiliary engagement unit is adapted to engage portions of the second drill string component, said portions being positioned at a longitudinal axial distance from each other.

17. The device according to claim 1, wherein the angle variation unit is configured to vary the angle of the gripped first drill string component after longitudinal axial alignment of the gripped first drill string component with the second drill string component.

* * * * *